United States Patent [19]

Burzi et al.

[11] Patent Number: 4,625,185

[45] Date of Patent: Nov. 25, 1986

[54] RESONANT CIRCUIT FOR THE EXTRACTION OF THE CLOCK FREQUENCY OSCILLATION FROM THE DATA FLOW

[75] Inventors: Giuseppe Burzi, Costamasnaga; Giovanni Mengoli; Luciano Pogliani, both of Milan, all of Italy

[73] Assignee: Telettra, Telefonia Elettronica e Radio S.p.A., Milan, Italy

[21] Appl. No.: 590,363

[22] Filed: Mar. 16, 1984

[30] Foreign Application Priority Data

Mar. 17, 1983 [IT] Italy ..... 20135 A/83

[51] Int. Cl.[4] ..... H01P 7/08

[52] U.S. Cl. ..... 333/204; 333/219

[58] Field of Search ..... 333/219, 220, 221, 234, 333/235, 204, 203, 202, 205, 246, 245

[56] References Cited

U.S. PATENT DOCUMENTS

| | | | |
|---|---|---|---|
| Re. 31,470 | 12/1983 | Bedord et al. | 333/219 X |
| 2,945,195 | 7/1960 | Matthei | 333/204 |
| 3,534,301 | 10/1970 | Golembeski | 333/204 |
| 3,617,955 | 11/1971 | Masland | 333/204 |
| 4,110,715 | 8/1978 | Reindel | 333/204 |
| 4,418,324 | 11/1983 | Higgins | 333/204 |
| 4,429,289 | 1/1984 | Higgins, Jr. et al. | 333/204 |
| 4,536,725 | 8/1985 | Hubler | 333/204 |

FOREIGN PATENT DOCUMENTS

| | | | |
|---|---|---|---|
| 1926501 | 11/1970 | Fed. Rep. of Germany | 333/204 |
| 0103202 | 6/1983 | Japan | 333/204 |
| 0136107 | 8/1983 | Japan | 333/204 |

*Primary Examiner*—Eugene R. LaRoche
*Assistant Examiner*—Benny Lee
*Attorney, Agent, or Firm*—Holman & Stern

[57] ABSTRACT

A resonant circuit for extracting a signal at a bit frequency from a data flow, at a clock frequency lower than microwave frequencies. The circuit has good frequency, selectivity and stability even under varying operative conditions, and in particular at varying temperatures. The circuit includes a G-shaped strip line section, which has an appropriate length to resonate at a predetermined range of frequencies, and is applied on an amorphous quartz substrate. The extraction system includes the above resonant circuit, a data flow input circuit, and an output circuit for amplifying the extracted signal.

4 Claims, 3 Drawing Figures

RESONANT CIRCUIT FOR THE EXTRACTION OF THE CLOCK FREQUENCY OSCILLATION FROM THE DATA FLOW

BACKGROUND OF THE INVENTION

1. Technical Field

The present invention relates to a resonant circuit for extracting a signal at a hit frequency from a data flow, e.g., P.C.M., and for assuring a good performance level in terms of frequency selection and stability during changes in environmental conditions particularly during temperature changes. The resonant circuit according to the present invention comprises a short-circuited line section fixed on a quartz substrate; in the relevant extraction system, it is preceded by a data flow input circuit and followed by an output circuit amplifying the signal extracted by said resonator.

2. The Prior Art

It is well-known that a transmission line section closed in a short-circuit has resonant characteristics and therefore presents a band-pass circuit with respect to the signal component present at its input, at the frequency fo, which corresponds a wave length "λ" equal to four times the length "l" of said line section. In other words the oscillation filtered by the resonator with a line length of "l" has the frequency: $fo=Vp/\lambda=Vp/(4l)$, where Vp is the propagation speed of an electromagnetic wave transmitted by the line and depends substantially on the material used as dielectric substrate. Conversely, when it is desired that a line section extract a component having frequency fo, its length "l" must be equal to: $l=Vp/(4fo)$. In practice these properties can be utilized when they do not involve too high "l" values, that is, when fo is very high; in fact the use of resonant lines has been, until now, confined within the microwave field (that is, within the very high frequencies corresponding to very short wave lengths). However, there are data transmission systems of the PCM type which operate in frequency ranges corresponding to wavelengths that are well below the "microwave" region and these systems are becoming more common. Therefore, clock signal extraction is usually carried out by means of LC resonant circuits having lumped parameter components and, if necessary, with distributed inductances L (bobbins in spiral form). These conventional resonators present several drawbacks, among which can be mentioned the inconvenience caused by low selectivity due to limited Q-factors of components, and by signal irradiations in air, mainly when relatively high frequencies (but still well under the microwave frequencies) are employed, such as the frequency involved in a line system at 565 Mbit/s.

SUMMARY OF THE INVENTION

It is therefore an object of the present invention to provide a resonant circuit for the extraction of oscillations having clock frequencies much lower than frequencies microwave, including a line section having a length reduced to acceptable values.

An additional object of the present invention is to provide a resonant circuit having a line section of acceptable length for the extraction of high frequencies (but much lower than the microwave frequencies) that does not have the drawbacks of conventional resonators and, more particularly, has a high Q-factor and therefore high selectivity characteristics.

A further object of the present invention is to provide a resonant circuit with a line section applied on a dielectric substrate to obtain, with the aid of reduced lengths of this line section, not only a high Q-factor and, therefore, high selectivity, but also excellent performance stability under varying environmental conditions, particularly in the presence of temperature changes.

BRIEF DESCRIPTION OF THE DRAWINGS

These and other objects, features and many of the attendant advantages of the invention will be better understood upon a reading of the following detailed description when considered in connection with the accompanying drawings wherein like parts in each of the several figures are identified by the same reference numbers, and wherein.

DETAILED DESCRIPTION

The above objects and advantages are achieved by a resonant circuit according to the present invention which comprises a strip-shaped line section which is electrically open (isolated electrically) at one end and is electrically closed to another part of the circuit at the other end, and which has a length reduced within acceptable limits and is applied on a quartz substrate. Preferably the substrate is a parallelepiped-shaped plate having thickness "h", the strip-line is applied on one of the major external faces while a metal film layer is applied on the opposite face.

In an advantageous embodiment of the invention the strip extends along the greatest longitudinal axis of the external plate face and its free end is near and parallel to one of the external edges of said face, the other end extending up to the opposite cross edge from where it continues on to the entire plate thickness and is connected to the metalization covering the opposite face.

According to another feature of the invention the major strip face includes two conductive sections that are orthogonal to the strip axis and are offset along this axis one from the other. Each strip section extends from the strip to a different longitudinal edge of said major face that supports them, the input signal being applied on a first longitudinal edge between the free end of one of said sections and the underlying metal film layer, the output signal being drawn from the second opposite longitudinal edge between the free end of the second conductive section and the underlying metal film layer.

In a preferred embodiment of the invention the line section is made-up by parallel sections, each connected to the other, the distance between the nearest sections being such as to avoid couplings and the input and output circuits being formed by straps.

Different aspects and advantages of the invention will be better understood from the description of some preferred and non-limiting embodiments, which are described herein for illustrative purposes only.

Figure 1:
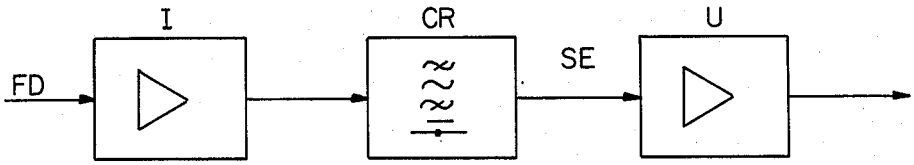
FIG. 1 is a block diagram of the extraction system.
Figure 2:
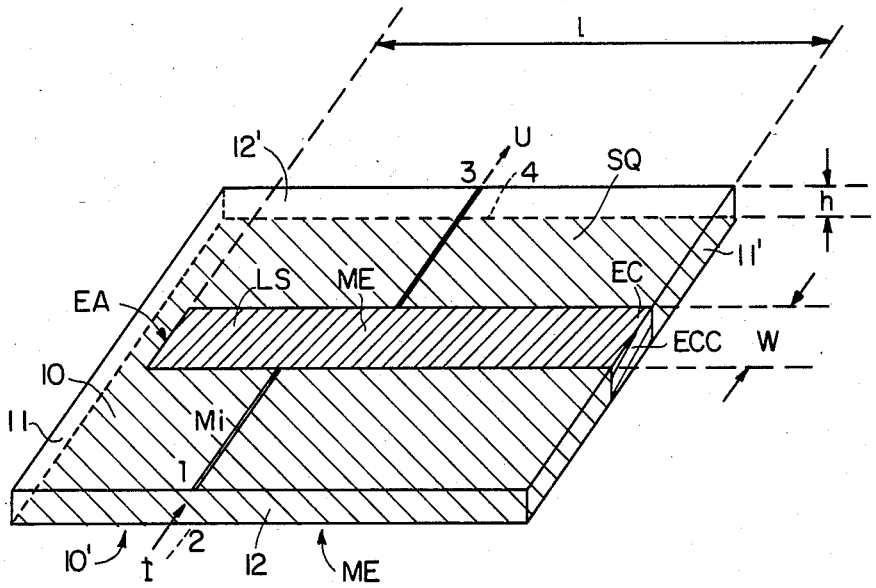
FIG. 2 is a schematic, partial and perspective view of a resonant circuit.

With reference to the scheme shown in FIG. 1, the extraction system includes on the whole: an input circuit (I) for the input data (FD) from which the signal at the bit frequency is to be extracted; the real resonant circuit (CR) and an output circuit (U) of the extracted signal (SE), whose amplitude is preferably amplified to the desired level taking into account the value of any downstream impedance beyond the output of the amplifier (not represented). Whilst the input (I) and output (U) circuits can be of conventional type, the resonant circuit (CR) according to the invention is made-up (FIG. 2) of a dielectric substrate (SQ), on which an electrically conductive line (LS) is fixed. According to the first feature of the invention, the substrate (SQ) determined by the two major faces orthogonal to the upper (10) and lower (10') drawing planes and by the four minor lateral faces 1–11' and 12—12', has an electrically conductive strip-line (LS) having a length "l" (indicated in FIG. 2 by a double-headed arrow) on the upper major face 10 extending from its free end EA to its end EC on the edge generated by the intersection of the two faces 10 and 11'. The end EC is electrically "closed" by the section ECC on the wall 11', with a lower metal film layer ME on the lower major face 10'. The input signal (FD) is applied between lines 1 and 2, where line 1 is a second very narrow metalization layer (MI) applied on the upper face; likewise the output signal (U) is drawn from lines 3 and 4.

The Q-factor of a resonator made-up of a strip line (CR according to FIG. 2) increases ideally with a mathematical formula approximately proportional to the square root of the frequency. It appears then that it is possible to get, with a high operating frequency, selection characteristics better than those related to traditional resonant circuits. The limitations of the theoretical values depend essentially on the manner in which the resonator is connected to the input and output circuits, as it is usually made in any resonant circuit type. The reduce sizes (width "W", length "l") of the line section (LS) to acceptable values and the stability of the system performances are reached through a proper selection of the substrate material (SQ) as a function of the stability of its dielectric constant in relation to the temperature and to its mechanical coefficients of thermal expansion.

If the selected substrate (SQ) is characterized by a low dielectric loss value, an optimum value of the resonant Q-factor is also assured. Finally, from the selection of the substrate material will also depend on the type of technique to be used for the deposition of the metalization (ME) on said substrate. For example, in the specific application of clock signal extraction from the data flow of PCM signals at a 565 Mbit/sec rate, the use for the substrate (SQ) of alumina (A1203, $\xi=10.1$, Tg $\delta=10^{-4}$) or of G10 ("epoxy glass", $\xi_r=4.4$, Tg $\delta=80\times10^{-4}$), has been disregarded because even if these materials allow acceptable lengths of lines (LS), they do not satisfy the specifications referring to stability during temperature changes and the selectivity level. We have surprisingly found that by selecting as material for the substrate (SQ) the amorphous quartz characterized by the following values:

relative dielectric constant: $\xi_r=3.826$ (25° C.)÷3.834(100° C.)

dielectric loss: $Tg\delta=1\times10^{-4}$ thermal expansion coefficient: $\alpha=0.55\times10^{-6}$ an optimum result is reached by using an acceptable length "l".

According to a more preferred feature of the invention, the metallization (ME) is made of silver (Ag) and it is deposited on the quartz by means of thick film technology. The dimensions "w" and "h" of the strip line (LS) are established essentially as a function of the Q-factor that one intends to reach, once the frequencies of the signal to be filtered are given and compatibility of the dimensions of the commercially available quartz plate have been taken into account.

In a particularly preferred embodiment in which an oscillation having frequency fo=564.992 MHz is to be extracted, we have found that a satisfactory result is reached by selecting w=10 mm and h=1.2 mm.

For instance, when the oscillation frequency f to be extracted decreases (to 140 Mbit/s, corresponding to 140 MHz), in order to maintain the same Q, for ex.=600, it would be necessary to increase "w" and "h" or otherwise one should be content with a lower Q.

The signal propagation speed along the line (LS), owing to the physical characteristics of substrate (SQ) and the line geometry, results from the calculations: Vp=0.58c, where:

c=propagation speed in vacuum

Therefore the length is;

l=78 mm.

The theoretical Q-factor calculated amounts to:

Q=606

In the embodiment of the maximum practical utility, (FIG. 3), which allows maintaining the highest possible filter selectivity around the required frequency when the resonator is connected into the extraction system shown in FIG. 1, we have found that it is advantageous not to connect the resonator directly with input (I) and output (U) circuits; rather, the resonator should be connected through an input line MI (on body 10) ending in short-circuit towards earth or ground (ME on 10') to electrically close the input circuit, and through output straps MU that are also deposited on the SQ line substrate laterally to the resonator. Straps MV act as antennas for the input of FD-signal coming fom I. The output signal SE is taken from the resonator CR.

In this way a superior resonator, under conditions similar to no-load condition (without load) is obtained; the connection loss arising from this procedure is compensated, as required, by the following output amplifier U.

Listed hereunder are certain parameters and measures made on the system in accordance with the scheme shown in FIG. 1.

Figure 3:
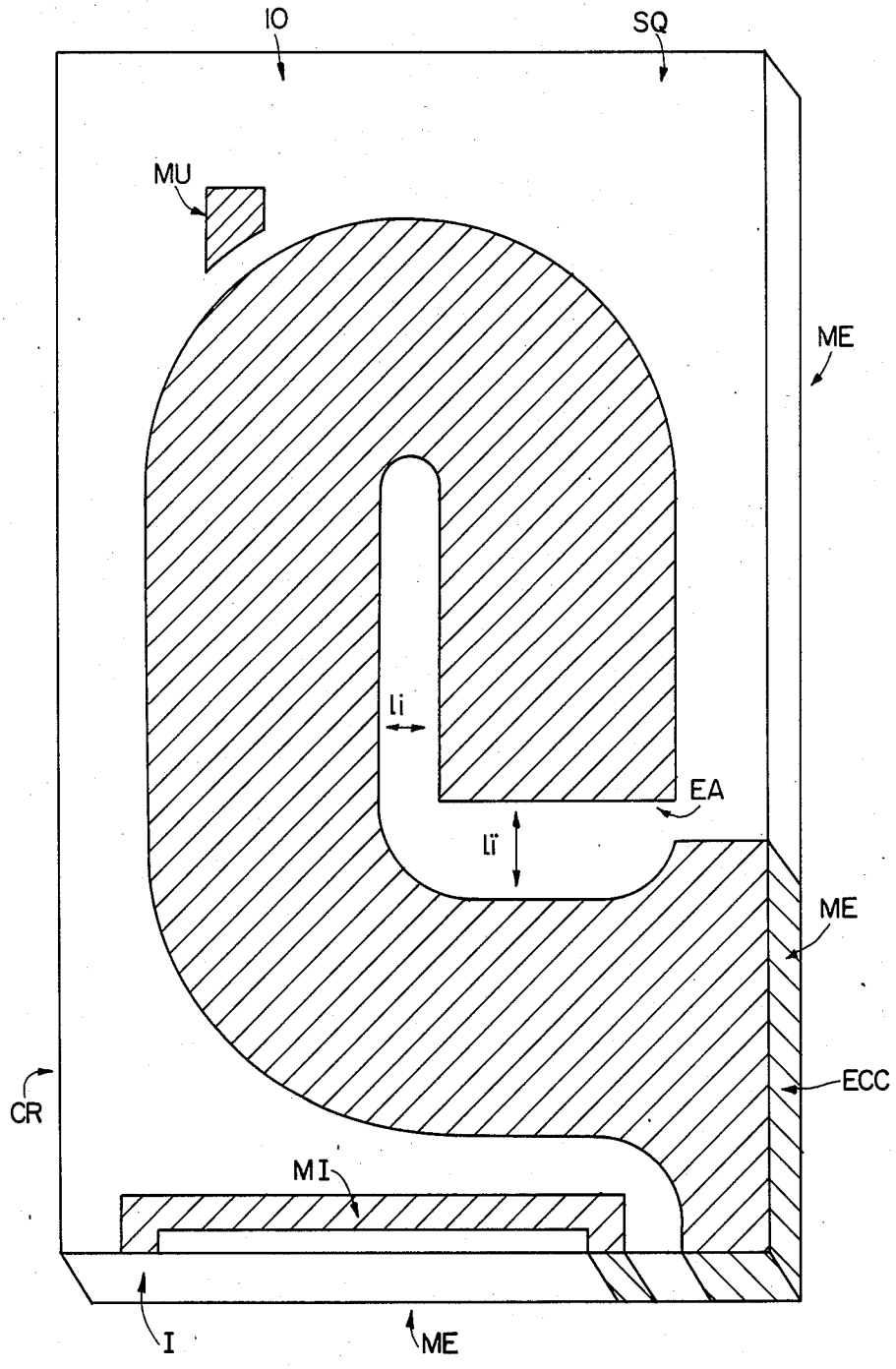
FIG. 3 is also a partial, perspective view showing a preferred embodiment.

The resonant element used is represented in its actual configuration in FIG. 3.

Measurements at Room Temperature (20° C.)

Total system gain: G=−12 dB

Filter insertion loss: −26 dB

Resonance frequency: fo=564.992 MHz

Band width at −3 dB: B=(563.952+566.022) MHz

Q-factor: Q=270

Mesurements at Temperature from −10° C. to +60° C.

Gain variations: ±1.1 dB

Total variation of resonance frequencies: fo=370 KHz equal to 9.5 ppm/°C.

Q-factor variations: Q(−10° C.)=287; Q(+60° C.)=258

As an alternative the same resonant circuit can be realized using, as the substrate material, mono-crystalline quartz having dielectric constant: $\xi=4.6$.

This involves a slightly lower propagation speed and therfore a line length which is reduced by an insignificant amount from the length of the line made of amorphous quartz. In this case the deposition of metallization MI and above all ME (in this case, made of copper) requires a thin film technology application. In practice the performances of this resonator at room temperature coincide with those of the foregoing case; on the contrary, the stability of these performances is slightly lower during temperature changes.

A resonant element of the same type described for application at 565 Mbit/sec can, e.g., also be used for the extraction of timing (clock) signals from the data flow at 140 Mbit/sec.

The resonance at these frequencies would require a greater length of the line section. In any case, this increase in length can be limited within acceptable dimensions by compensating for the suppressed line section with a concentrated or lumped parameter capacitance (not represented) connected in parallel with the same line and having a suitable value of C.

The performances of this system, in terms of Q-factor and stability in temperature, are believed to result from the line geometry and from the characteristics of the capacitor used, operated and when at 140 Mbit/sec they have proved more satisfactory.

Referring to FIG. 3, it can be clearly seen that the overall dimensions of the filter can be greatly reduced by imparting the strip in the form of a loop or hook, e.g., in G-form or the like, with line sections substantially parallel to each other and with minimum distances "$l_i$" and "$l'_i$" as to prevent appreciable couplings.

Having described several embodiments of the present invention, it is believed that other modifications, variations and changes will be suggested to those of ordinary skill in the art in light of the disclosure herein. It is therefore to be understood that all such variations, modifications and changes are believed to fall within the scope of the invention as defined by the appended claims.

What is claimed is:

1. A resonant strip line circuit comprising:

a dielectric substrate having a first surface with predetermined length and width;

and electrically conductive strip disposed on said first surface and including a plurality of interconnected sections joined by bends in said strip, the total length of said strip being greater than each of said predetermined length and width;

input signal coupling means for electro-magnetically coupling input signals to said strip adjacent to said interconnected sections, output signal coupling means for electro-magnetically coupling output signals, which is located adjacent from said strip at another of said interconnected sections;

said dielectric substrate being composed of quartz; and said conductive strip having a generally G-shaped configuration.

2. The resonant strip line circuit according to claim 1 wherein said conductive strip and interconnected sections having said G-shaped configuration include first and second parallel and spaced sections, said first and second sections each having two respective ends, and a third section joining respective ends of said first and second sections, and a fourth section in contact with said first section and spaced from said second section.

3. The resonant strip line circuit according to claim 2 wherein said first and second sections extend along the length direction of said substrate; said third section is arcuate and joins the first ends of said first and second sections, and said fourth section extends generally along the width direction of said substrate and in contact with the second end of said first section, said fourth section being being spaced from the second end of said second section.

4. The resonant strip line circuit according to claim 3 wherein said quartz substrate is amorphous quartz.

* * * * *